United States Patent [19]

Rasmussen

[11] 3,951,826

[45] Apr. 20, 1976

[54] ALL PURPOSE LIQUID DETERGENT

[75] Inventor: Per Hforth Rasmussen, Copenhagen, Denmark

[73] Assignee: Colgate-Palmolive Company, New York, N.Y.

[22] Filed: July 13, 1973

[21] Appl. No.: 378,883

[30] Foreign Application Priority Data

July 25, 1972 France ..... 72.26689

[52] U.S. Cl. ..... 252/8.9; 252/89 R; 252/135; 252/173; 252/523; 252/527; 252/DIG. 14

[51] Int. Cl.[2] ..... C11D 1/34; C11D 1/83; C11D 3/075; D06M 13/32

[58] Field of Search ..... 252/89, 135, DIG. 1, 252/DIG. 14, 8.9, 523, 527

[56] References Cited

UNITED STATES PATENTS

| | | | |
|---|---|---|---|
| 2,908,651 | 10/1959 | Grifo | 252/551 |
| 3,001,945 | 9/1961 | Drew | 252/539 |
| 3,168,478 | 2/1965 | Stefcik | 252/135 |
| 3,294,693 | 12/1966 | Dupre | 252/135 |
| 3,366,571 | 1/1968 | Cooper | 252/99 |
| 3,591,508 | 7/1971 | Huggins | 252/135 X |
| 3,624,006 | 11/1971 | Karg | 252/529 |
| 3,738,943 | 6/1973 | Kaneko | 252/540 |
| 3,844,982 | 10/1974 | Connor | 252/544 |

FOREIGN PATENTS OR APPLICATIONS

| | | | |
|---|---|---|---|
| 1,300,829 | 12/1972 | United Kingdom | 252/8.9 |

*Primary Examiner*—Dennis L. Albrecht
*Attorney, Agent, or Firm*—John J. Tomaszewski; Murray M. Grill; Herbert S. Sylvester

[57] ABSTRACT

A single phase, all purpose heavy duty liquid detergent composition which contributes softening and antistatic properties to the laundry consisting essentially of non-ionic detergent, builder, a mixture of mono and di-phosphate esters of higher alkyl ethoxylates and lower alkyl mono and di- phosphate esters, and water.

8 Claims, No Drawings

ALL PURPOSE LIQUID DETERGENT

This invention relates to single phase, all purpose, heavy duty liquid detergent compositions. More particularly, it relates to such compositions which contain a detergent constituent which serves to stabilize the liquid detergent and maintain it in a single phase while it also contributes softening and antistatic properties to the textiles and laundry washed with such detergent. Therefore, the present liquid detergents do not require the addition of a hydrotrope to make single phase products and maintain them uniform and stable during lengthy storage periods.

It has recently been discovered that phosphate esters and mixtures thereof, especially if ethoxylated, are useful additives for detergent compositions to impart softening properties to washed laundry and textiles. This has made it possible for detergents to be produced which do not require special additions of softening compositions in the laundry rinse water nor applications of softener to the laundry in an automatic laundry dryer. Also, it has allowed the use of a single detergent product, whether for hand or machine washing of laundry, which simultaneously softens laundry washed, especially cotton articles and cotton-synthetic blends, without a special softening treatment being needed.

Although heavy duty liquid detergents are often employed in washing machines they are also useful for washing walls, floors, woodwork, screens, automobile tires, porcelain- and enamelware, such as sinks, toilets and bathtubs, ceramic and plastic tiles and in general, almost all interior hard household surfaces except windows. For most of such applications softening capabilities are irrelevant. Heavy duty cleaning power and comparatively low foaming characteristics are important. The cleaning power is usually contributed by an anionic detergent but such detergents are often high foaming and therefore antifoaming additives are often employed. In the present compositions the phosphoric ester salts function as anionic detergents and yet do not foam objectionably. They are also of excellent compatibilities with nonionic detergents, which may be used to furnish additional cleaning power and with inorganic or organic builder salts, which improve the overall detergency of the product.

Another important requirement for most liquid detergents is that a single phase be maintained so that the product being dispensed is of a uniform composition and is attractive to the consumer. Because inorganic salts in aqueous media often create an electrolyte of higher ionic charge than the detergents or organic builders there is a tendency for such compositions to separate and stratify. To overcome this hydrotropic materials are generally employed. In the present compositions, however, it is found that in addition to contributing softening and detergency, the phosphoric esters also maintain the stability of the liquid detergent, holding it in a single phase for lengthy periods of storage. Therefore, it is not required to employ special hydrotropes such as alkali metal isopropyl benzene sulfonate, potassium toluene sulfonate, sodium xylene sulfonate or sodium benzene sulfonate.

In accordance with the present invention a single phase, all purpose heavy duty liquid detergent comprises a major proportion of water and minor proportions of a nonionic synthetic organic detergent which is a polyethoxylated ethanol of a lipophilic material, a builder salt or mixture of such salts and a mixture of phosphoric acid mono- and diester salts of lipophil polyethoxyethanols and alkanols which contribute detergency to the product and stabilize it against phase separation during storage. More specifically, the invention is of such a liquid detergent which comprises from about 75 to 95% water; 0.4 to 5% of nonionic detergent of the formula $RO(CH_2CH_2O)_nH$ wherein R is a higher alkyl of 8 to 16 carbon atoms and $n$ is from 3 to 10; 3 to 12% of a builder salt which is a tri-alkali metal nitrilotriacetate or tetrapotassium pyrophosphate; 0.1 to 4% of $R^1O(CH_2CH_2O)_mPO(OM)_2$, wherein $R^1$ is a higher alkyl of 14 to 20 carbon atoms, $m$ is from 1 to 6 and M is an alkali metal or ammonium; 0.1 to 3% of $[R^1O(CH_2CH_2O)_m]_2POOM$; 0.1 to 2% of $R^2OPO(OM)_2$, wherein $R^2$ is alkyl of 6 to 10 carbon atoms; and 0.1 to 1% of $(R^2O)_2POOM$.

The active detersive and softening phosphoric esters are $R^1O(CH_2CH_2O)_mPO(OM)_2$, designated (I), wherein $R^1$ is a higher alkyl of 14 to 20 carbon atoms, $m$ is from 1 to 6 and M is an alkali metal or ammonium and $[R^1O(CH_2CH_2O)_m]_2POOM$ (II). Of these compounds it is considered that the diester is more effective as a softener and the monoester is a more powerful detergent. However, the combination appears to be especially useful and both products possess detersive and softening properties. Additionally, although essentially non-foaming they do not interfere with the foaming of other anionic detergents with which they may be formulated. In addition to the polyethoxylated esters mentioned, there will usually be present with these, alkyl phosphates of formulas $R^2OPO(OM)_2$ (III) and $(R^2O)_2POOM$ (IV). These help to disperse and solubilize the polyethoxy phosphoric esters and facilitate their manufacture and use. In these compounds $R^1$ is preferably higher alkyl of 16 to 18 carbon atoms, $m$ is preferably 1 to 4, M is preferably alakali metal and $R^2$ is usually of 7 to 9 carbon atoms. Most preferably $R^1$ is a higher alkyl which is a mixture of alkyls of 16 to 18 carbon atoms, $m$ is about 2, M is sodium but sometimes may better be potassium, and $R^2$ is of about 8 carbon atoms and most preferably is 2-ethylhexyl. Instead of employing the salts of the phosphoric ester acids, the acid forms themselves may be added into the mixer, preferably after previous addition of surface active or detersive material, such as a nonionic detergent, and may be converted to the desired salt by admixing therewith of a base, such as sodium hydroxide or potassium hydroxide.

In the preferred mixtures of phosphoric esters proportions of I:II and III:IV are 4:1 to 2:3, preferably 2:1 to 1:1, and 9:1 to 1:1, preferably 4:1 to 3:2 for the total of I and II to the total of III and IV. The total of the proportions of phosphoric ester salts used in the liquid detergent will be sufficient so that they contribute significant detergency to the product and stabilize it against phase separation during storage, while also adding fabric softening properties so that when the all purpose liquid detergent is utilized as a laundry detergent the textiles washed with it will not have a hard hand. In the liquid detergents of this invention such proportions will usually be 0.1 to 4% of I and 0.1 to 3% of II. Such materials may be present in the liquid detergent without phosphoric ester salts III and IV but usually those additional esters will accompany I and II because they tend to solubilize I and II even more, facilitate manufacture thereof and aid in stabilizing liquid detergents containing esters I and II together with ionic builder salts. Normally then, from 0.1 to 2% of III will be present together with 0.1 to 1% of IV. Preferable concentrations of such materials in these liquid detergents include 0.6 to 1% of I, 0.4 to 0.8% of II, 0.2 to 0.6% of III and 0.1 to 0.4% of IV. In most preferred embodiments of the invention proportions of such materials will be 0.8% of I, 0.6% of II, 0.35% of III and 0.25% of IV and the phosphoric ester salts employed will be those previously described as the most preferable.

The essential nonionic detergent constituent of the present compositions, which also possesses surface active or surfactant properties to a significant extent, is a condensation product of polyethoxylated ethanol and a lipophilic material. Suitable lipophilic materials for making such nonionic compounds are known in the art and include propylene oxides, alkyl phenols and higher alcohols. In the present liquid detergents the higher alcohols are highly preferable. These are usually of 8 to 16 carbon atoms, preferably of 10 to 12 carbon atoms and most preferably are mixed linear 10 to 12 carbon atom alkanols, although Oxo alcohols and somewhat branched alcohols are also of use as donors of R, at least in part. Such alkyls may be derived from synthetic alcohols or preferably, from linear alkanols obtained from natural sources, such as hydrogenated coconut oil. The proportions of such nonionic compounds in the liquid detergent will usually be from 0.4 to 5%, preferably 0.5 to 2% and most preferably about 1%. The number of ethoxy groups, designated by *n*, is usually from 3 to 10, preferably from 4 to 7 and most preferably is about 5.

The inorganic builder salt is one which increases the detergency of the phosphoric esters and/or the nonionic surface active material. Among the most useful of such builder salts are the alkali metal pyrophosphates such as tetrapotassium pyrophosphate, tetrasodium pyrophosphate, the alkali metal nitrilotriacetates, such as mono-, di- and tri-potassium and corresponding sodium nitrilotriacetates, the alkali metal carbonates, e.g., potassium carbonate and sodium carbonate, the alkali metal bicarbonates, the di-alkali metal 2-hydroxyethyl iminodiacetates, alkali metal citrates, alkali metal gluconates and other useful inorganic and organic salts known to have building capabilities. In liquid systems such as the present one it will generally be preferred for the alkali metal used to be potassium because potassium salts are more soluble. This also applies to the phosphoric esters but for economic reasons it may sometimes be preferable to use the sodium salts. When mixed alkali metal salts are present in the liquid compositions there is an equilibrium established so that the pyrophosphate may be considered to be partially of an alkali metal other than potassium and this can be undesirable. In some cases, ammonium salts of the various components may be useful because they often are more soluble than sodium salts and frequently even more soluble than potassium salts. The proportion of builder salt will generally be between 3 and 17% to produce good cleaning and maintain the single phase, but different concentrations are used for different builders. For example, when tri-alkali metal nitrilotriacetate is used it will normally be to the extent of 3 to 10% whereas 8 to 12 % of tetrapotassium pyrophosphate will be employed. When the two are mixed, normally in about equal proportions, from 5 to 10% of the mixture will usually be sufficient. Optionally, but highly preferably, there will be present with such builders a supplementing quantity of an alkali metal carbonate, preferably potassium carbonate, although sodium carbonate is also good, and such quantity will be from 1 to 5%, preferably 3%. When the builder is tripotassium or trisodium NTA the most preferred proportion to be used is 5.6% and when tetrapotassium pyrophosphate is the builder such proportion will be 10%, in each case with 3% of alkali metal carbonate being a supplemental builder and alkaline agent. Another supplemental material which may be desirably present in these compositions is free hydroxyl which can result from use of an excess of sodium hydroxide during neutralization of acid components which are to be employed in the salt form, e.g., the phosphoric esters, or of ammonium hydroxide, additionally added to the compositions. Usually, the amount of ammonium hydroxide will be from 0.2 to 0.6% and preferably will be about 0.4%. The free alkali and/or other alkaline materials present will be in such proportion as to make the final liquid pH, in 1% aqueous solution, in the range of 9 to 11, preferably 9.5 to 10.5.

Various optional ingredients may be employed, including any of a large number of adjuvants, such as thickeners, opacifiers, bactericides, bleaches, buffers, anti-redeposition agents, perfumes, fungicides, antioxidants, stabilizers and solvents. Normally the contents of individual adjuvants will be held to about 2% although the proportion of solvent may be 10% and in some cases can be as high as 25%, especially when the solvent is isopropanol. Normally however, the total of adjuvants will not exceed 10% of the product and seldom will it be more than 5%. For most adjuvants less than about 1% will be used. In the present composition opacifiers may be employed to give the product an attractive appearance. Such opacifiers include castor waxes and behenic acid. The proportion of opacifier will usually be from 0.1 to 0.5%, preferably about 0.2%. The opacified liquid is still considered to be a single phase liquid, for purposes of this description.

The water employed may be ordinary tap water, even of hardnesses up to 300 parts per million as calcium carbonate, but is preferably soft water, of hardness less than 100 p.p.m., and most preferably is deionized water.

Methods for the manufacture of the present liquid detergents are uncomplicated and trouble-free. All that is required is to admix the various constituents and the order of additions of components is non-critical. However, in those cases wherein acid forms of components of the product are to be neutralized during the formulation procedure, it is generally advisable for the acid or the neutralizing agent to be added, preferably in about stoichiometric proportion, after addition of the nonionic surfactant and water and before the balance of the composition. By such addition any side reactions of the acid or base with the other constituents are avoided. Normally the formulation of the various materials takes place in a mixer kept under continuous nonviolent agitation. At the end of the manufacturing procedure the pH may be adjusted by the addition of alkali metal hydroxide or ammonium hydroxide so as to place it in the desired final range of 9 to 11, preferably 9.5 to 10.5. The pH may also be regulated by addition of alkaline salts.

After manufacture, the detergent composition, usually at room temperature, is bottled and sent to storage. Such compositions are stable, single phase, opacified products, if opacifying agent is present. Otherwise, they are visually clear or translucent. After storage periods of six months under a variety of conditions the product does not stratify or show other signs of instability and is essentially the same in appearance as when initially manufactured. In those cases wherein particular combinations of components are such that the product is not of the highest degree of stability it may be desirable to utilize an additional amount of phosphoric ester mix or, in some instances, some of the already mentioned hydrotropes may be added, usually in a quantity not exceeding that of the phosphoric esters present. Also, if the building function of the tetrapotassium pyrophosphate or NTA salt is insufficient, more of such materials may be utilized or the amount of desirable supplemental builder, such as potassium or sodium carbonate, may be increased. However, such increases generally will be less than 50% of the original amounts specified or employed.

In practical cleaning applications the normal washing quantities of the liquid detergent composition are used, so that from ¼ to 1 cup (2 to 8 ounces or 60 to 240 ml.) of liquid is employed to wash approximately 8 to 15 lbs. (3.6 to 6.8 kg.) of laundry in about 10 to 20 gallons (38 to 76 liters) of water. The water will usually be at a temperature of 30° to 80°C., most often about 65°C. and washing in an automatic washing machine will take from 5 minutes to 1 hour. At the conclusion of washing the laundry, which may be of cotton, cotton-synthetic blends or various synthetics such as polyesters, nylons, rayons, and permanent press treated materials, the laundered items are noticeably softer than items washed with a control commercial detergent, to both trained and untrained observers. This improvement is most evident on cottons, especially towels and terry-cloth items. Washing with the invented detergent also helps to prevent accumulation of static charges, which is most important on the synthetic materials. Such results are also obtainable when laundry and textiles are subjected to hand washing under approximately the same conditions of concentrations, times and temperatures. When employed for washing floors, walls, and other hard surface materials the all purpose detergent foams satisfactorily but not excessively and cleans well. Normally for such uses the detergent concentration in water will be greater than for laundry use, usually being in the range of 0.3 to 1%, at which concentrations it is very effective. Greater concentrations of the liquid detergent may also be employed and often it is used without dilution for special cleaning jobs and the removal of stains. For example, small quantities thereof may be applied directly to remove grease spots from walls and to pretreat shirt collars and cuffs before regular laundering.

The following examples illustrate but do not limit the invention. Unless otherwise indicated, parts are by weight and temperatures are in °C.

EXAMPLES

| | | Parts |
|---|---|---|
| | Water (150 p.p.m. hardness, as $CaCO_3$) | 87.8 |
| * | $RO(CH_2CH_2O)_nH$ | 1.0 |
| ** | $R^1O(CH_2CH_2O)_mPO(ONa)_2$ | 0.8 |
| ** | $[R^1O(CH_2CH_2O)_m]_2POONa$ | 0.6 |
| *** | $R^2OPO(ONa)_2$ | 0.35 |
| *** | $(R^2O)_2POONa$ | 0.25 |
| | Trisodium nitrilotriacetate | 5.6 |
| | Sodium carbonate | 3.0 |
| | Ammonium hydroxide | 0.4 |

EXAMPLES-continued

| | | Parts |
|---|---|---|
| | Opacifier (Butakin) | 0.2 |

*R = mixed linear $C_{10}$ and $C_{12}$alkyls and n is about 5.
**$R^1$ = mixed linear $C_{16}$ and $C_{18}$ alkyls and m is about 2.0.
***$R^2$ = 2-ethylhexyl A single phase, all purpose, heavy duty liquid detergent of the above formula is made by adding 85.5 parts of tap water to a mixing tank, dissolving 1 part of the nonionic detergent therein, adding 1.6 parts of an aqueous sodium hydroxide solution, analyzing 19.1% $Na_2O$, gradually adding to this solution 1.8 parts of a mixture of the phosphoric esters corresponding to the salts listed, in acid forms, such additions being gradual to promote complete neutralization, and following this neutralization with additions and dissolvings of 6 parts of trisodium nitrilotriacetate monohydrate, 3 parts sodium carbonate, anhydrous, 0.8 part of aqueous ammonium hydroxide (25% $NH_3$) and 0.2 part of opacifier. The additions are carried out in an uninsulated, unjacketed vessel because the heat of neutralization generated is small and readily taken up by the body of the detergent composition. Instead of adding all the water initially some may be reserved to dissolve various salts or to disperse the less soluble materials so that these may be added as solutions or dispersions, to promote quick solutions or reactions. Also, if desired, the phosphoric ester acids may be added in a solvent, e.g., ethanol, or heated to melted state.

The product made is a single phase, opaque, all purpose liquid detergent which is so stable that 6 months after manufacture it is still unseparated and of its original appearance. When employed in washing cotton towels in either a top loading or horizontal drum washing machine, under normal conditions, with a concentration of liquid detergent corresponding to 0.2% in the wash water and a towel:wash water weight ratio of about 1:15, the towels are washed clean and are found to be softer than those washed with control compositions not containing the phosphoric ester salt mixture and softer than those washed with commercial heavy duty liquid or powdered detergents.

When the 6% of trisodium nitrilotriacetate monohydrate is replaced with 10% of tetrapotassium pyrophosphate, with the water content being decreased accordingly, a similarly acceptable product is obtained, which is also stable and washes and softens well.

When in both such formulations the aqueous sodium hydroxide solution employed is replaced with aqueous potassium or ammonium hydroxide solution in amount to exert the same neutralizing effect the products made are also stable against phase separation (they may be even more stable because of the improved solubilities of the potassium and ammonium salts of the phosphoric ester acids). Similar improvements are obtained by utilizing potassium carbonate in place of the sodium carbonate and by employing tripotassium nitrilotriacetate.

In further variations of the formula opacifier is omitted to produce a clear or translucent product, dyes are included to color this, deionized water is employed, additional hydrotrope, e.g., sodium cumene sulfonate, potassium xylene sulfonate, is added and variations are made in the proportions and types of the various constituents, within the ranges given in the preceding specification. Products so made are useful liquid detergents with softening capabilities and are stable on storage. Although it is preferred to employ deionized water, it is noted that the use of medium and even high hardness tap water does not promote separation of the phases, or precipitation out of the hardness, apparently due to the combination of materials in the present formulations or specific components thereof.

The invention has been described with respect to various illustrations and examples thereof but is not to be limited to them because it will be evident to one of skill in the art how modifications may be made, equivalents employed and substitutes utilized without departing from the spirit or scope of the invention.

What is claimed is:

1. A single phase, all purpose heavy duty liquid detergent which consists essentially of from 75 to 95% water; 0.4 to 5% of nonionic detergent of the formula $RO(CH_2CH_2O)_nH$ wherein R is a higher alkyl of 8 to 16 carbon atoms and *n* is from 3 to 10; 3 to 17% of a builder salt or mixture of such salts selected from the group consisting of organic builder salts and alkali metal or ammonium inorganic builder salts; 0.1 to 4% of $R^1O(CH_2CH_2O)_mPO(OM)_2$; 0.1 to 3% of $[R^1O(CH_2CH_2O)_m]_2POOM$; 0.1 to 2% of $R^2OPO(OM)_2$; and 0.1 to 1% of $(R^2O)_2POOM$, wherein $R^1$ is a higher alkyl of 14 to 20 carbon atoms, $R^2$ is an alkyl of 6 to 10 carbon atoms, *m* is from 1 to 6 and M is an alkali metal or ammonium, said mixture of phosphoric acid mono- and diester salts contributing detergency to the product and stability against phase separation during storage.

2. A liquid detergent according to claim 1 wherein the builder salt is selected from the group consisting of alkali metal pyrophosphates, alkali metal nitrilotriacetates, alkali metal carbonates and bicarbonates, dialkali metal 2-hydroxyethyl iminodiacetates, alkali metal citrates and alkali metal gluconates.

3. A liquid detergent according to claim 1 wherein the builder salt is in an amount from about 3% to 12% and is a tri-alkali metal nitrilotriacetate or tetrapotassium pyrophosphate.

4. A liquid detergent according to claim 1 wherein the water content is about 80 to 90%; the nonionic detergent is one wherein R is of 10 to 12 carbon atoms, *n* is from 4 to 7 and from 0.5 to 2% thereof is present; the builder salt content is about 3 to 10% of trisodium nitrilotriacetate, about 8 to 12% of tetrapotassium pyrophosphate or about 5 to 10% of a mixture thereof; and the phosphoric acid mono- and di-ester salts include 0.6 to 1% of $R^1O(CH_2CH_2O)_mPO(OM)_2$; 0.4 to 0.8% of $[R^1O(CH_2CH_2O)_m]_2POOM$; 0.2 to 0.6% of $R^2OPO(OM)_2$; and 0.1 to 0.4% of $(R^2O)_2POOM$, wherein $R^1$ is a higher alkyl of 16 to 18 carbon atoms, $R^2$ is alkyl of 7 to 9 carbon atoms; *m* is from 1 to 4 and M is an alkali metal.

5. A liquid detergent according to claim 4 wherein the proportions of $R^1O(CH_2CH_2O)_mPO(OM)_2$ to $[R^1O(Ch_2CH_2O)_m]_2POOM$ and of $R^2OPO(OM)_2$ to $(R^2O)_2POOM$ are from 4:1 to 2:3 and the proportion of the total of $R^1O(CH_2CH_2O)_mPO(OM)_2$ and $[R^1O(CH_2CH_2O)_m]_2POOM$ to the total of $R^2OPO(OM)_2$ and $(R^2O)_2POOM$ is from 9:1 to 1:1.

6. A liquid detergent according to claim 5 which also comprises from 1 to 5% of alkali metal carbonate and from 0.2 to 0.6% of ammonium hydroxide.

7. A liquid detergent according to claim 6 substantially of the formula

| | Parts |
|---|---|
| Water | 87.8 |
| $RO(CH_2CH_2O)_nH$ (R = mixed linear $C_{10}$ and $C_{12}$ alkyls and n is about 5) | 1.0 |
| $R^1O(CH_2CH_2O)_mPO(ONa)_2$ ($R^1$ = mixed linear $C_{16}$ and $C_{18}$ alkyls and m is about 2.0) | 0.8 |
| $[R^1O(CH_2CH_2O)_m]_2POONa$ | 0.6 |
| $R^2OPO(ONa)_2$ ($R^2$ = 2-ethylhexyl) | 0.35 |
| $(R^2O)_2POONa$ | 0.25 |
| Trisodium nitrilotriacetate | 5.6 |
| Sodium carbonate | 3.0 |
| Ammonium hydroxide | 4.0 |
| Opacifier | 0.2. |

8. A liquid detergent according to claim 6 substantially of the formula

| | Parts |
|---|---|
| Water | 83.4 |
| $RO(CH_2CH_2O)_nH$ (R = mixed linear $C_{10}$ and $C_{12}$ alkyls and n is about 5) | 1.0 |
| $R^1O(CH_2CH_2O)_mPO(ONa)_2$ ($R^1$ = mixed linear $C_{16}$ and $C_{18}$ and m is about 2.0) | 0.8 |
| $[R^1O(CH_2CH_2O)_m]_2POONa$ | 0.6 |
| $R^2OPO(ONa)_2$ ($R^2$ = 2-ethylhexyl) | 0.35 |
| $(R^2O)_2POONa$ | 0.25 |
| Tetrapotassium pyrophosphate | 10.0 |
| Sodium carbonate | 3.0 |
| Ammonium hydroxide | 0.4 |
| Opacifier | 0.2. |

* * * * *